United States Patent [19]

Gorham et al.

[11] 4,089,423

[45] May 16, 1978

[54] RIFLE STAND

[76] Inventors: Jack R. Gorham, 3966 Lugo, Lynwood, Calif. 90262; Harold W. Chalker, 12820 Frailey, Compton, Calif. 90221

[21] Appl. No.: 759,919

[22] Filed: Jan. 17, 1977

[51] Int. Cl.[2] ..... A47F 7/00

[52] U.S. Cl. ..... 211/64; 248/156

[58] Field of Search ..... 211/60, 64; 248/156, 248/240, 240.4

[56] References Cited

U.S. PATENT DOCUMENTS

| | | | |
|---|---|---|---|
| 3,225,734 | 12/1965 | Bule | 248/156 X |
| 3,519,234 | 7/1970 | Matson | 248/156 |
| 3,952,878 | 4/1976 | Gorham | 211/64 |

*Primary Examiner*—Roy D. Frazier
*Assistant Examiner*—Terrell P. Lewis
*Attorney, Agent, or Firm*—Georges A. Maxwell

[57] ABSTRACT

A foldable and collapsible rifle stand comprising a vertical spade shaped earth-engaging spike with front and rear surfaces, a vertical and forwardly opening channel and a foot engaging head at the upper end of the spike and bridging the channel, an elongate, vertical column slidably engaged in the channel and with said header, a rest plate at the upper end of the column and defining laterally spaced rearwardly opening rifle stock grip receiving notches; said column is shiftable from a down position where the plate occurs adjacent the header to an up position where it is spaced above the header, an elongate flat butt support pivotally carried by the header and shiftable from a vertical position where it occurs adjacent said rear surface to a horizontal position where it projects rearwardly from the header and in which position it defines horizontal upwardly disposed support surfaces to engage the butt ends of rifle stock and a pair of laterally spaced forwardly disposed butt head-engaging stops in downward and rearward spaced relationship from said notches, and means releasably retaining the column in its up and down positions and the support in its horizontal position comprising upper and lower bolt receiving openings in the column, a spring-loaded manually engageable bolt carried by the header and engageable in said openings and a latch hook carried by the bolt and engageable with the support.

8 Claims, 8 Drawing Figures

RIFLE STAND

This invention has to do with a portable, collapsible rifle stand for use in the field and which serves to engage in the earth and to engage the butt and grip portions of related long guns or rifles, to releasably hold and maintain the rifles in a substantially vertical, upwardly pointed direction for ready manual engagement and use.

The prior art to which our invention relates is old and highly developed. The prior art provides numerous collapsible, portable rifle stands which are adapted to be engaged in the earth in a hunting area and on or with which one or more rifles can be effectively engaged and supported, ready for immediate use, whereby the hunters, while in wait for game, need not fatigue themselves by hand-holding their rifles during their wait.

The ordinary gun or rifle stand of the character referred to above and provided by the prior art includes a lower earth or ground engaging spike portion, an intermediate gun butt support means to engage below and support the lower butt end of related rifles and an upper rifle barrel engaging means against which the barrels of related rifles rest, in inclined relationship therewith.

It is apparent from the above that those in the art consider it necessary that the barrel engaging means be spaced a substantial distance of the butt supporting means and that the barrels of the related rifles be engaged and supported.

It is also apparent that those who provided the prior art structure noted above believed that it was necessary to provide extensively spaced points of supporting contact between the butts and barrels of rifles to provide safe, effective and stable support for rifles when disposed in substantially vertical, slightly inclined resting positions.

As a result of this apparent belief, the butt supporting and barrel engaging means of rifle stands provided by the prior art are spaced from 20 to 30 inches.

The lower ground engaging spike end or portions of ordinary gun stands provided by the prior art are from 8 inches to 12 inches in vertical or longitudinal extent and it is considered desirable that the butt supporting means be spaced about 2 inches above the surface of the ground.

In accordance with the above, the ordinary gun or rifle stand is from 32 inches to nearly thirty-six inches in overall length and is such that it cannot be easily and conveniently transported unless it is made collapsible and/or foldable for purposes of transport and/or storage.

If the above noted stands are made collapsible or foldable so that they can be reduced one-half in longitudinal extent, they can be made reasonably economically and can be made sufficiently rigid and durable for practical use.

If such gun stands are made so that they can be reduced to less than one-half their normal operating length, they become more complicated and costly to manufacture and inevitably become unstable and delicate or fragile, unless they are reinforced as by heavier materials, in which case they become too heavy to be desirable to use and are not practical or marketable.

An example of the above is that gun stand which I invented and which is disclosed in our U.S. Pat. No. 3,952,878, issued Apr. 27, 1976, for "GUN STAND". The noted patented Gun Stand which is mechanically satisfactory is too costly to manufacture and is such that if it is made sufficiently light to be practical, it becomes so weak and unstable that its serviceability is left to doubt. It has also been reasonably ascertained that the noted patented Gun Stand is not sufficiently simple, structurally and functionally, to satisfy the demands of the purchasing public and has not attained commercial success.

We have determined that in order to safely and effectively support a rifle in a substantially vertical upwardly pointed direction, by means of a Gun Stand of the general class here involved, above a butt supporting means, it is not necessary and is in fact undesirable to provide barrel engaging means spaced twenty or more inches above the butt support means and that a gun stock grip engaging means or rest, spaced about seven or eight inches above and offset from the butt support and the provision of a cleat or stop on the butt support to engage the heel of the rifle butt provides the most effective and most desirable support for a related rifle.

In such a structure, it is only necessary that the stop on the butt support means be spaced to one side of the vertical axis which passes through the grip engaging means or rest and that the grip engaging means or rest be spaced above the support means a distance to afford sufficient leverage and/or mechanical advantage over the turning moments of force generated by the rifle so as not to overstress the supporting structure and to impart into the resulting structure a relationship whereby adequate and acceptable latitude of relative movement of the rifle to the structure, upon engaging, resting and removing the rifle from the structure, is provided.

An object and feature of our invention is to provide a rifle stand including a lower earth engaging spike means, a rifle butt engaging means spaced above and laterally offset from the spike means to occur below and engage the butt end of a rifle stock and having a butt heel engaging stop means; and a rifle stock grip engaging means or rest spaced above the butt engaging means to occur adjacent and to engage one side of a related stock grip; said grip engaging means being below the barrel and the center of gravity of the rifle and said stop means occurring in both lateral and vertical spaced relationship from the point of contact between the rest and stock grip.

Another object and feature of our invention is to provide a foldable and collapsible rifle stand which is approximately 19 inches long when in use and approximately 10 inches long when collapsed and folded; a stand which is about five inches wide in maximum lateral extent; and a stand which is about 2½ inches in depth or thickness when collapsed and folded, whereby the stand, when collapsed and folded establishes a neat, flat, easy and convenient to transport and/or store assembly measuring approximately 10 inches by 5 inches by 2½ inches.

It is an object and feature of our invention to provide a stand of the character referred to above which includes three basic, relatively movable parts and including a simple, single, manually operable retaining means or latch to selectively engage and releasably maintain the parts in their extended and/or open position or in their collapsed and/or folded position.

A further object and feature of our invention is to provide a stand of the character referred to above wherein the spike means is a substantially unitary assembly formed of sheet metal, the butt supporting means is a unitary fabricated metal structure or a formed sheet metal part pivotally connected with the spike means and shiftable from a normal position to a folded position relative thereto; said grip engaging means or rest is an elongate fabricated unit slidably engaged with the spike means and shiftable from an extended or up position to a collapsed or down position and said retaining means or latch is carried by the spike means and selectively releasably engages and maintains the rest and support means in each of their two positions relative to the spike means.

A particular object and feature of our invention is to provide a gun stand or support of the general character referred to above wherein all elements, parts and means are small, light, easy and economical to manufacture and wherein said elements, parts and means are easy and economical to assemble, operate and maintain.

The foregoing and other objects and features of our invention will be fully understood from the following detailed description of one typical preferred form and application of the invention throughout which description reference is made to the accompanying drawing in which:

FIG. 7 is a view taken substantially as indicated by line 7—7 on FIG. 4; and

Figures 1, 2, 3, 4, 5, 6, 8:
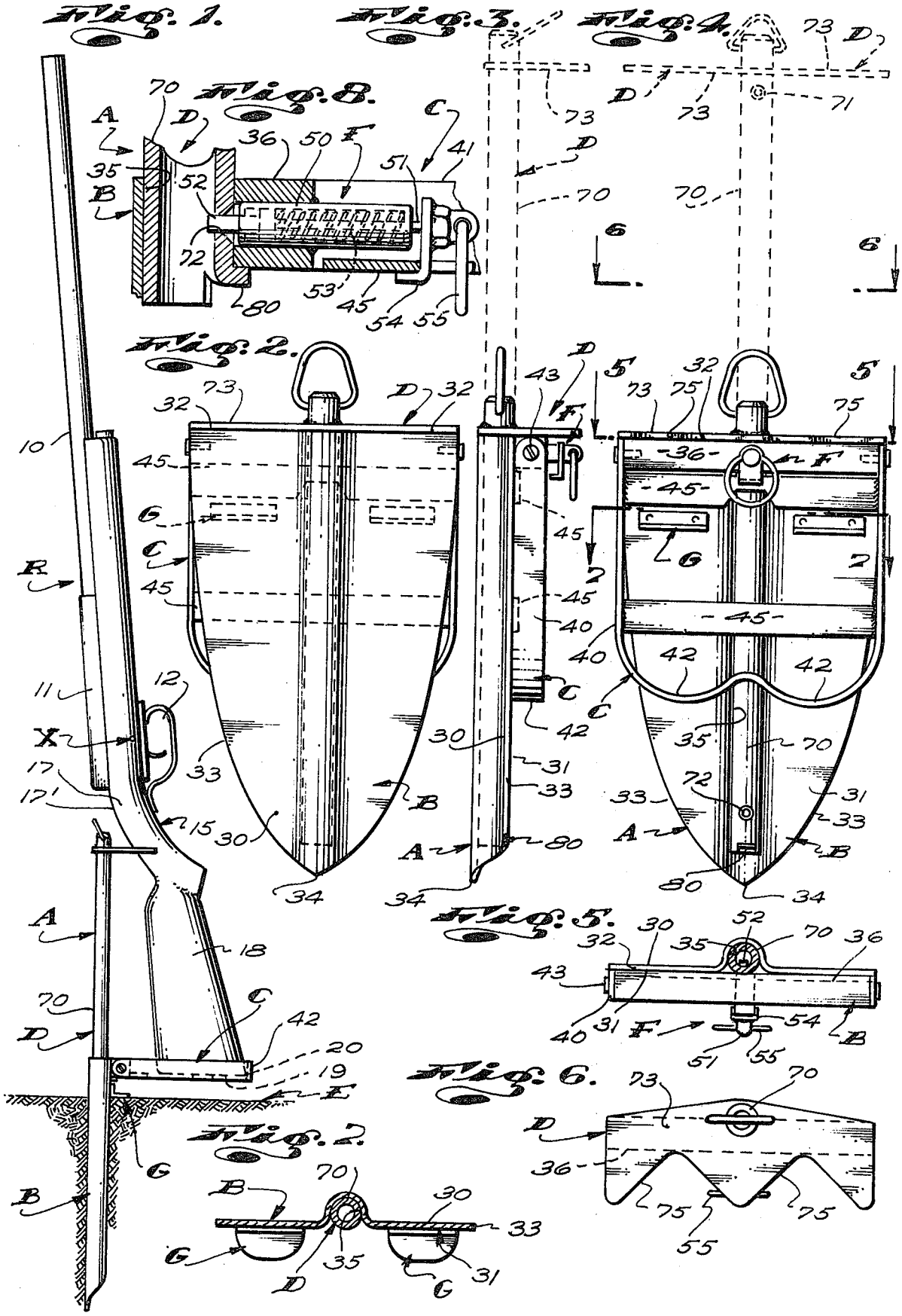
FIG. 1 is an elevational view showing our new Rifle Stand in use.
FIG. 2 is a front view of my Rifle Stand, showing it in a folded position.
FIG. 3 is a side view of the structure shown in FIG. 2 and showing parts in another position, in phantom lines.
FIG. 4 is a rear view of the structure shown in FIG. 3.
FIG. 5 is a view taken substantially as indicated by line 5—5 on FIG. 4.
FIG. 6 is a view taken substantially as indicated by line 6—6 on FIG. 4.
FIG. 8 is an enlarged detailed sectional view of the latch means that we provide.

The rifle stand A shown throughout the drawings is adapted to be engaged in the earth E to project upwardly thereform and to releasably cooperatively engage one or two rifles R and to support the rifle or rifles for convenient ready manual engagement, manipulation and use.

The ordinary rifle R such as is shown in FIG. 1 of the drawings and with which my stand is to be used, includes, generally, an elongate barrel 10 with front and rear ends, a breech and trigger mechanism or assembly 11 and 12 related to the rear end portion of the barrel and an elongate manually engageable stock 15 related to the barrel, breech and trigger assembly and extending freely rearwardly therefrom.

The stock 15, as shown in the drawings, has a forward portion or forearm 16 which occurs at and extends substantially parallel with the rear end portion of the aforementioned assembly; a downwardly and rearwardly contoured central hand engaging portion or grip 17 adjacent the rear end of the breech and trigger assembly and a rear portion or butt 18. The butt 18 of the stock is a generally flat, vertical and rearwardly divergently formed portion of the stock and defines a normally vertically extending rearwardly disposed shoulder engaging butt end or surface 19. The butt end surface 19 converges with the lower longitudinal edge portion of the butt to define a lower rear corner or heel 20 on the butt.

In the instant case, when the rifle is disposed substantially vertically and related to the stand A, the shoulder engaging or butt end 19 is and will be hereinafter descriged as occurring at the lower end of the butt and the heel 20 is and will hereinafter be described as being disposed rearwardly and at the lower rear corner of the butt. The grip 17 of the butt is and will be described as being curved downwardly and rearwardly and as having a downwardly and rearwardly curved forwardly disposed edge 17'.

It is to be further and particularly noted that the stock is formed so that the grip 17, in effect, offsets the butt portion of the stock rearwardly relative to the forearm portion 16 and that the heel 20 of the butt occurs on a vertical plane spaced a substantial distance rearward from the forward edge 17' of the stock grip 17.

Finally, the center of gravity of the rifle occurs a substantial distance above the stock grip 17 within the break area of the rifle, as for example, at the mark X.

While the exact portioning, shape and disposition of the above noted elements, parts and portions of each different make and model of rifle may differ, one from the other, in the overwhelming majority of cases, rifles are relatively and sufficiently close to being the same with respect to all parameters, whereby the stand A here provided can effectively and cooperatively engage and support them.

The stand A that we provide includes an earth-engaging spike or spike means B, butt supporting means C, a grip rest or engaging means D, and retaining or latch means F.

The spike or spike means B is a flat, vertical spade-like sheet metal part with front and rear surfaces 30 and 31, a horizontal transversely extending top edge 32 and opposite downwardly converging and laterally inwardly curved side edges 33 converging at the lower or tip end of the spike to establish an earth piercing 34.

The spike B is formed with an elongate forwardly projecting and vertically and rearwardly opening vertical channel 35, coextensive with the central vertical axis of the spike and corresponding, generally, with the cross-section of a vertical column of the means D which will hereinafter be described. The channel 35 is shown as having a semi-circular forward portion or bottom and lateral spaced, rearwardly and outwardly radiused side portions.

The spike B next includes an elongate horizontal bar-like header 36 spot-welded or otherwise fixed to and extending laterally across the rear surface 31 of the spike adjacent the upper edge 32 thereof and overlying the upper rear portion of the channel 35. The header 36 reinforces the spike, establishes a foot engaging part, serves as mounting means for the butt support means C and for the releasable retaining means or latch F.

Finally, the spike B can, if desired, include earth engaging stop means G to limit engagement of the spike into the earth and to afford some additional stability to the construction.

In the case illustrated, the means G includes small, flat, horizontal, flange-like pads of sheet metal, suitably spot-welded or otherwise fixed to the rear surface 31 of the spike, at opposite sides of the channel 35 and spaced below the header 36. In practice, the pads of the means G can advantageously be formed integrally with the spike by a suitable piercing and bending operation performed on the stock from which the spike is established and carried out coincidentally with forming of the spike.

The inclusion of the mans G and the form such means takes is considered to be a matter of choice.

The spike B is preferably about nine inches long and about five inches wide and is established of 1/16" aluminum alloy plate or sheet stock.

The channel 35 is about one inch in major inside dimension or diametric extent and the header is established of ¾ inch square bar stock.

It will be apparent that the spike B illustrated and described above is a small, light, simple and inexpensive to make part or unit.

The butt support means C, as shown in the drawings, is a fabricated structure including a modified U-shaped exterior frame 40 established of, for example, ⅝ inch by ¼ inch metal strap and characterized by elongate parallel legs or sides 41 and a double radiused or undulating bottom or base portion defining two laterally spaced substantially semi-circular butt heel engaging stops 42, opening inwardly of the U-shaped frame, in the direction in which the legs or sides 41 of the frame project from said base portion. The free ends of the legs or sides 41 of the frame 40 overlie the opposite ends of the header 36 on the spike B and are pivotally connected therewith by means of pivot and retaining screw fasteners 43 engaged through the legs and into the header, as clearly shown in the drawings.

The frame of the means C is pivotal from the down or folded, vertical position where it depends from the header and occurs adjacent the rear surface 31 of the spike, as shown in FIGS. 2 through 6 of the drawings, to an open or up position where it extends horizontally rearwardly from the spike as shown in FIGS. 1 and 8 of the drawings.

The major dimension of the stock establishing the frame 40 is vertical when the frame is in its up or horizontal position, whereby the frame has top and bottom edges on vertically spaced planes.

In addition to the frame 40, the means C includes a butt supporting bottom structure comprised of a plurality (2), support bars 45 extending transversely between the legs 41 of the frame, at the bottom edges or lower plane thereof and adapted to engage and stop the butt end 19 of rifle stocks related to the construction, when it is in use.

The bar 45 which is most closely related to header 36 is positioned so that it is in close proximity to the header but allows for free pivoting of the frame relative to the header.

The bars 45 are preferably established of the same stock as is the frame and are fixed to the frame as by welding.

In practice, the fasteners 43 serve to establish snug frictional engagement between the frame and header, whereby the frame can be pivoted from one to the other of its two positions, with moderate force and will remain in such positions in the absence of applied external forces.

It will be abundantly clear and apparent that the means C need not be a fabricated structure such as is shown, but can be a unitary formed sheet metal part, if desired, and if economic factors relating to the manufacture and/or sale of the construction justify the expense of necessary and appropriate tooling.

The releasable retaining means F that we provide includes a cylinder 50 secured in a central through opening in the header 36 and projecting rearwardly from the header, a shaft 51 with a forwardly projecting pin end 52 normally projecting from the forward end of the cylinder and from the header into the confines of the channel 35 and a manually engageable rear end portion projecting rearwardly from the cylinder. The cylinder and shaft have suitable axially spaced opposing stops and a compression spring 53 is arranged in the cylinder about the shaft and between the stops to normally yieldingly urge the shaft forwardly relative to the cylinder. The rear end portion of the shaft is provided with a downwardly and thence forwardly projecting latch 54 which normally engages or hooks under the bar 45 of the means C when the frame is in its up position and serves to releasably hold the frame in said up position.

The rear manually engageable end of the shaft can as shown, pivotally carry a suitable finger-engaging ring 55.

The means F, except for the latch 54, is a simple, inexpensive commercially available spring-loaded bolt device. The latch 54 is a simple to make part and is easy to fix to the shaft of the noted bolt device.

It will be apparent from the above that the means C is a simple, easy and economical to make, light-weight fabricated unit which is easy to couple and relate to the spike and that the releasable retaining means F is such that it effectively holds the means C in its up position when desired.

The rest or grip engaging means D that we provide includes an elongate, vertical tubular column 70 corresponding generally in vertical extent with the spike and slidably engaged with and between the forward side of the header 36 and the adjacent upper portion of the channel 35 in the spike.

The column is shiftable from a lower collapsed position where its major portion is slidably cooperatively received in the channel 35 and its upper end portion projects freely above the spike a limited distance; to an upper extended position where its lower end portion is engaged by and between the header 36 and the adjacent upper end portion of the channel 35.

The column has upper and lower rearwardly opening pin receiving openings 71 and 72 which occur in axial alignment with and receive the pin 52 of the means F when the column is in its upper and lower positions, to releasably hold the column in those positions.

Next, the means D includes a grip rest means or plate 73 at the upper end of the column. The means 73 can vary in form and is shown as a flat, horizontal plate-like part corresponding in lateral extent with the spike. The rest has a rear portion that normally overlies the upper end of the spike and has a forward portion with a pair of laterally spaced vertically and rearwardly opening V-shaped stock grip receiving and engaging notches 75.

The upper terminal end of the column can, as shown, be provided with a manually engageable ring 36.

It will be apparent from the foregoing that the means D is simple, light-weight and inexpensive to make and to assemble with the spike B. It will also be apparent that the means F effectively releasably retains the means D in its two positions.

Each notch 75 of the means D is spaced forward of one related stop 42 of the means C a distance which is sufficient so that when the stand A is in its extended open position and a rifle is engaged with it, as shown in FIG. 1 of the drawings, where the rearwardly disposed heel 20 of the rifle stock engages the forwardly disposed stop 42 of the means C and the rifle is inclined forwardly and upwardly at an angle sufficient to cause the rifle to tip and fall forwardly and downwardly with certainty and reasonable force, the notches 75 engage the rear edge of the stop grip 17 whereby the rifle is stopped from tipping further forward and where the turning moments of force exerted through the rifle, about the means D, urges and holds the heel of the stock in snug stopped engagement with the stop 42.

The notches 75 are preferably V-shaped so as to centralize the central portion of the rifles relative to the means D and the radiused stops of the means C serve to centralize the lower butt ends of the rifles relative to the means C, with the result that the rifles related to the stops 42 and notches 75 are effectively centralized and suitably prevented from shifting out of alignment and from supported engagement in or with the stand structure.

In practice, the notches 75 of the means D, when the structure is in its extended position, occur about 8 inches above the means C which is close to the mean longitudinal center of the gun stock grips. The fore and aft placement or spacing of the stops 42 and notches 75 is such that should the notches engage the upper or lower limits of the stock grip or should the fore and aft placement of the notch-engaged portion of the grip be other than average, the structure will still effectively support the rifle.

It will be noted that with the stand structure here provided, when the stand is in its folded or collapsed position, the overall longitudinal or vertical extent of the assembly is only slightly greater than the length of the spike B, for example, it is only 9¼ inches or 9½ inches in overall length.

As noted previously, the rest plate of the means C is only as wide as the spike or about five inches wide. The major fore and aft dimension of the plate need not exceed 2½ inches and is of minimal or longitudinal extent. When the structure is collapsed and the means C is in its down position, the plate serves to shroud and protect the upper end of the spike, the opposing adjacent end of the means C and the means F, as clearly shown in the drawings.

When folded and collapsed, our new rifle stand is a small, neatly packed, light-weight structure which is easy and convenient to carry, transport and/or store.

When it is desired to put the stand to use, the means F is manually operated to release the column; the column is pulled to its extended position and the pin of the means F is reset into engagement therewith. Following the above, the means G is pivoted from its down or folded position to its up or open horizontal position and the means F is operated to latch it in place. Thereafter, the spike is engaged with the earth and, as by placing a foot on top of the spike at one or the other side thereof, the spike is driven into supported engagement in the earth. With the stand thus set, the rifle or rifles to be related thereto is or are manually set into engagement in and with the stand, as described above, and as clearly shown in FIG. 1 of the drawings. Setting the stand up, as noted above, can be effected in less than thirty seconds. Taking the stand down or putting it out of use, for transport and storage, is effected by simple reversal of the above procedure and takes no greater time.

In practice, the means F provided to releasably maintain the several parts of the structure in their different positions can be effected by simple set screws and the like and need not include the particular latch means illustrated and described above.

Further, in practice and as shown in the drawing, the lower end of the column is provided with stop means 80 to prevent the column from being drawn from engagement with the spike when it is pulled to its extended position and to orient the lower pin receiving opening 72 in a common horizontal flame with the pin 52 and thereby facilitate engagement of the pin 52 in the opening 72.

Having described only one typical preferred form and application of our invention, we do not wish to be limited to the specific details herein set forth but wish to reserve to ourselves any variations and/or modifications that may appear to those skilled in the art and which fall within the scope of the following claims:

Having described our invention, we claim:

1. A rifle stand including an elongate, vertical, spade-like spike with front and rear surfaces, a horizontal top, downwardly and inwardly converging sides defining an earth piercing point, a vertically extending rearwardly opening channel and a horizontal, foot-engaging header extending transverse said top and overlying the upper end of said channel; an elongate normally horizontal butt support means with front and rear ends defining vertically disposed support surfaces and defining two laterally spaced forwardly disposed stops spaced rearward from the header and engageable with the butt ends and rearwardly disposed butt heels of rifle stocks related to the stand, means pivotally and frictionally securing the front end of the support means to the header and rearward of the spike whereby said support means is shiftable downwardly and forwardly to a vertical position adjacent said rear surface; manually operable releasable retaining means carried by the header releasably engaging the support means to hold it horizontal; stock grip-engaging means including an elongate vertical column slidable longitudinally in the channel from a down position where its upper end terminates adjacent said top to an up position where its lower end portion is engaged in and between the header and channel and a horizontal rest plate at the upper end of the column defining two laterally spaced vertically and rearwardly opening notches in common laterally spaced parallel vertical planes with said stops and on a lateral vertical plane spaced forward of the lateral vertical plane on which said stops occur, said notches receiving and engaging forwardly disposed edges of stock grips related to the stand and whose butt portions are supported and stopped by said support means, said retaining means releasably engaging and selectively stopping said column in said up and down positions.

2. The rifle stand set forth in claim 1 wherein said retaining means includes a manually engageable bolt with front and rear ends shiftably carried by said header with its front end normally projecting into said channel, upper and lower, rearwardly disposed openings in the column to accommodate the front end of the bolt and a hook at the rear end of the bolt releasably engaging and supporting the support means.

3. The rifle stand set forth in claim 2 which further includes a rearwardly projecting stop flange at the lower end of the column engaging a lower side of the header when the column is in its up position.

4. The rifle stand set forth in claim 1 which further includes a rearwardly projecting stop flange at the lower end of the column engaging a lower side of the header when the column is in its up position.

5. The rifle stand set forth in claim 1 wherein said retaining means includes a manually engageable bolt with front and rear ends shiftably carried by said header, spring means normally yieldingly urging the bolt forward, with its front end normally projecting into said channel, upper and lower, rearwardly disposed openings in the column to accommodate the front end of the bolt and a hook at the rear end of the bolt releasably engaging and supporting the support means.

6. The rifle stand set forth in claim 5 which further includes a rearwardly projecting stop flange at the lower end of the column engaging a lower side of the header when the column is in its up position.

7. The rifle stand set forth in claim 5 including flat horizontal earth surface engaging stop flanges on said rear surface spaced below said top.

8. The rifle stand set forth in claim 1 including flat horizontal earth surface engaging stop flanges on said rear surface below said top.

* * * * *